US011311795B1

(12) United States Patent
Lee et al.

(10) Patent No.: US 11,311,795 B1
(45) Date of Patent: Apr. 26, 2022

(54) SMART CUBE

(71) Applicant: OPTOLOGICS CO., LTD., Gyeonggi-do (KR)

(72) Inventors: Unha Lee, Gyeonggi-do (KR); Changsu Jung, Seoul (KR); Sangmin Lee, Gyeonggi-do (KR)

(73) Assignee: OPTOLOGICS CO., LTD.

( * ) Notice: Subject to any disclaimer, the term of this patent is extended or adjusted under 35 U.S.C. 154(b) by 0 days.

(21) Appl. No.: 17/152,497

(22) Filed: Jan. 19, 2021

(30) Foreign Application Priority Data

Dec. 11, 2020 (KR) ..... 10-2020-0173232

(51) Int. Cl.
*A63F 9/08* (2006.01)
*A63F 9/06* (2006.01)

(52) U.S. Cl.
CPC ..... *A63F 9/0842* (2013.01); *A63F 9/0612* (2013.01)

(58) Field of Classification Search
CPC ..... A63F 9/0842; A63F 9/0612
See application file for complete search history.

(56) References Cited

U.S. PATENT DOCUMENTS 4,817,952 A * 4/1989 Biro ..... A63F 9/0826 273/153 S
5,058,894 A * 10/1991 Levinn ..... A63F 9/0612 273/153 R
8,465,020 B2 * 6/2013 Dai ..... A63F 9/0842 273/153 S
2012/0302303 A1 * 11/2012 Rosendo ..... A63F 9/0842 463/9
2018/0161668 A1 * 6/2018 Chen ..... A63F 9/0842
2018/0311566 A1 * 11/2018 Shin ..... A63F 9/24
2019/0091559 A1 * 3/2019 Fu ..... A63F 13/2145
2019/0184275 A1 * 6/2019 Su ..... A63F 9/0842
2019/0358549 A1 * 11/2019 Osipov ..... A63F 9/0838
2019/0374849 A1 * 12/2019 Limaye ..... A63F 9/0842
2020/0009451 A1 * 1/2020 Dor ..... A63F 9/0842

FOREIGN PATENT DOCUMENTS

KR 20180116051 A * 10/2018
KR 10-1989125 6/2019
WO WO-2007046056 A2 * 4/2007 ..... A63F 9/0613

* cited by examiner

*Primary Examiner* — Steven B Wong
(74) *Attorney, Agent, or Firm* — Grossman, Tucker, Perrault & Pfleger, PLLC

(57) ABSTRACT

A smart cube is disclosed. An embodiment of the present disclosure may provide a smart cube, comprising: a main frame; and a plurality of unit blocks coupled to the main frame and constituting six faces of a regular hexahedron, wherein the unit block comprises: a display unit disposed on a surface of the unit block that is exposed to an outside; and a plurality of terminals disposed on a facing surface of the unit block facing another unit block for transferring electric power and data for the display unit, wherein the terminal is retrievably disposed in an insertion hole formed on the facing surface of the unit block, and wherein the terminal includes a permanent magnet for allowing a polarity of a retrieved end of the terminal to be opposite to a polarity of a retrieved end of a terminal of the other unit block such that the terminal is retrieved from the insertion hole and adhered to the terminal of the other unit block by a magnetic force.

9 Claims, 17 Drawing Sheets

SMART CUBE

CROSS-REFERENCE TO RELATED APPLICATIONS

This application claims the benefit of Korean Patent Application No. 10-2020-0173232, filed on Dec. 11, 2020, the disclosure of which is incorporated herein by reference in its entirety.

TECHNICAL FIELD

The present disclosure is related to a smart cube.

BACKGROUND

Cube, such as Rubik's Cube, as popularly known, generally refers to a kind of three-dimensional puzzle that consists of a plurality of unit blocks to form a regular hexahedron shape. The user of a cube may match each face of the regular hexahedron with the same color by rotating each face of the cube about the X-, Y- or Z-axis. The cubes are used by various age groups because they can help the users to improve their space perception and memory.

However, as the conventional cubes have provided no other functions than challenging the users to match each face with the same color, the users easily lost their interest in the cubes, causing the cubes to be short-lived.

To address this issue, the applicant of the present application has proposed a smart cube provided with a display unit for displaying various contents on each of the unit blocks constituting the cube. To this end, the blocks need to be installed with terminals for exchanging electric power and/or data with adjacent unit blocks. These terminals, however, need to be protruded from the surfaces of the units blocks in order to ensure a contact between two adjacent unit blocks, thereby inevitably increasing the frictional resistance between the unit blocks due to the contact and separation of the terminals during the rotation of the unit blocks. If the heights of the terminals were lowered to reduce the frictional resistance, the contact between the terminals would be jeopardized.

The prior art for the present disclosure is disclosed in KR Patent Publication No. 10-1989125 (Publication Date: Jun. 14, 2019; SMART CUBE, SYSTEM FOR PROVIDING CONTENTS USING IT AND METHOD THEREOF).

SUMMARY

A certain embodiment of the present disclosure provides a smart cube that may ensure a proper contact between terminals while reducing a frictional resistance that may be caused by the contact between the terminals during the maneuvering of the cube.

An aspect of the present disclosure may provide a smart cube, comprising: a main frame; and a plurality of unit blocks coupled to the main frame and constituting six faces of a regular hexahedron, wherein the unit block comprises: a display unit disposed on a surface of the unit block that is exposed to an outside; and a plurality of terminals disposed on a facing surface of the unit block facing another unit block for transferring electric power and data for the display unit, wherein the terminal is retrievably disposed in an insertion hole formed on the facing surface of the unit block, and wherein the terminal includes a permanent magnet for allowing a polarity of a retrieved end of the terminal to be opposite to a polarity of a retrieved end of a terminal of the other unit block such that the terminal is retrieved from the insertion hole and adhered to the terminal of the other unit block by a magnetic force.

The terminal may be slidably coupled with the insertion hole and electrically connected with the display unit through a flexible wire.

The terminal may further comprise a conductive layer configured to envelop the permanent magnet to provide a passage for transferring the electric power or data, the wire being coupled to the conductive layer.

The terminal may have a rounded portion formed at edge portions on the retrieved end of the terminal.

A stopper protrusion configured for restricting a maximum retrieval length of the terminal may be formed on an inner circumferential surface of the insertion hole, and the terminal and a terminal of another unit block may be in contact with each other at the rounded portion when retrieved to the maximum retrieval length.

The plurality of unit blocks may comprise: a plurality of center blocks rotatably coupled to the main frame and disposed at a center of each face of the regular hexahedron; a plurality of edge blocks disposed at edges of each face of the regular hexahedron; and a plurality of corner blocks disposed at corners of each face of the regular hexahedron, wherein the center block, the edge blocks and the corner blocks disposed on a same face of the regular hexahedron may be engaged with one another so as to be rotated with one another.

The main frame may be provided with a control unit for transferring the electric power and data to the plurality of center blocks, and the terminal may comprise a pair of power terminals and a pair of data terminals disposed on every facing surface.

The pair of power terminals may each transfer electric power having a different electric potential, and polarities at the retrieved ends of the pair of power terminals may be opposite to each other.

Data may be transferred between the display units disposed on a same face of the regular hexahedron, and data starting from a particular center block may pass through all of the plurality of edge blocks and the plurality of corner blocks disposed on a same face as the particular center block and then returns to the particular center block, and data received by edge blocks excluding an edge block receiving the data first from the particular center block may pass through the particular center block before being transferred to corner blocks.

The smart cube may further comprise a plurality of rotation detection units configured to detect a rotation direction and a rotation angle of each of the plurality of center blocks, and the control unit may be configured to compute a final position of each of the display units based on an initial position of each of the display units and results of detection by the plurality of rotation detection units and transfer data adapted for the final position of each of the display units to the plurality of center blocks.

The rotation detection unit may comprise: a fixing frame being coupled to the main frame; a circular ring being coupled to the center block, the center of the circular ring coinciding with a rotation axis of the center block; and a pair of photo interrupter sensors being coupled to the fixing frame, wherein the circular ring may comprise 4 sensing holes radially penetrating the circular ring, wherein the photo interrupter sensor may comprise a light-emitting unit and a light-receiving unit disposed on an inner side and an outer side, respectively, of the circular ring and facing each other in a radial direction of the circular ring, wherein detection signals may be generated when the sensing holes are positioned between the light-emitting unit and the light-receiving unit by the rotation of the circular ring, wherein the 4 sensing holes may be arranged at an interval of 90 degrees about the rotation axis of the center block, and wherein the pair of photo interrupter sensors may be arranged at an interval greater than or smaller than 180 degrees about the rotation axis of the center block.

The rotation detection unit may detect the rotation direction and the rotation angle of the center block based on the order and number of detection signals generated by the pair of photo interrupter sensors.

According to the embodiment of the present disclosure, the frictional resistance may be reduced during the maneuvering of the cube by having the terminals inserted in the insertion holes formed on facing surfaces of the unit blocks, and the contact between terminals may be ensured, once the maneuvering of the cube is completed, by having the terminals adhered to terminals of adjacent unit blocks by a magnetic force.

BRIEF DESCRIPTION OF THE DRAWINGS

The accompanying drawings, which are incorporated in and constitute a part of this specification, illustrate a certain embodiment and together with the description, serve to explain the principles of the disclosure.

DETAILED DESCRIPTION

Hereinafter, a certain preferable embodiment of the present disclosure will be described in detail with reference to the accompanying drawings. Unless explicitly defined otherwise, the terms used for describing the embodiment of the present disclosure shall be interpreted as commonly understood by a person ordinarily skilled in the art to which the present invention pertains. The terms are used for illustrative purposes only, and the present disclosure shall by no means be restricted to these terms.

Throughout the description, any expression in singular number shall be interpreted to include corresponding plural forms, unless explicitly mentioned otherwise. Moreover, when a component is described to, for example, "comprise" or "include" an element, such description shall be understood to cover that the component may also include another element or other elements. Moreover, when something is described to be "on" an element, it shall be appreciated that something may be "over" or "under" or "above" or "below" the element and that something is not necessarily positioned at an upper side of the element in the gravitational direction. Moreover, when one element is described to be "connected" or "coupled" to/with another element, it shall be appreciated that the one element may be not only connected or coupled directly to/with the other element but also connected or coupled indirectly to/with the other element by way of yet another element. Moreover, although certain elements may be described using "first," "second," and so on, these terms are used only to distinguish one element from another element and shall by no means define, for example, the nature, order or sequence of the elements.

Figure 1:
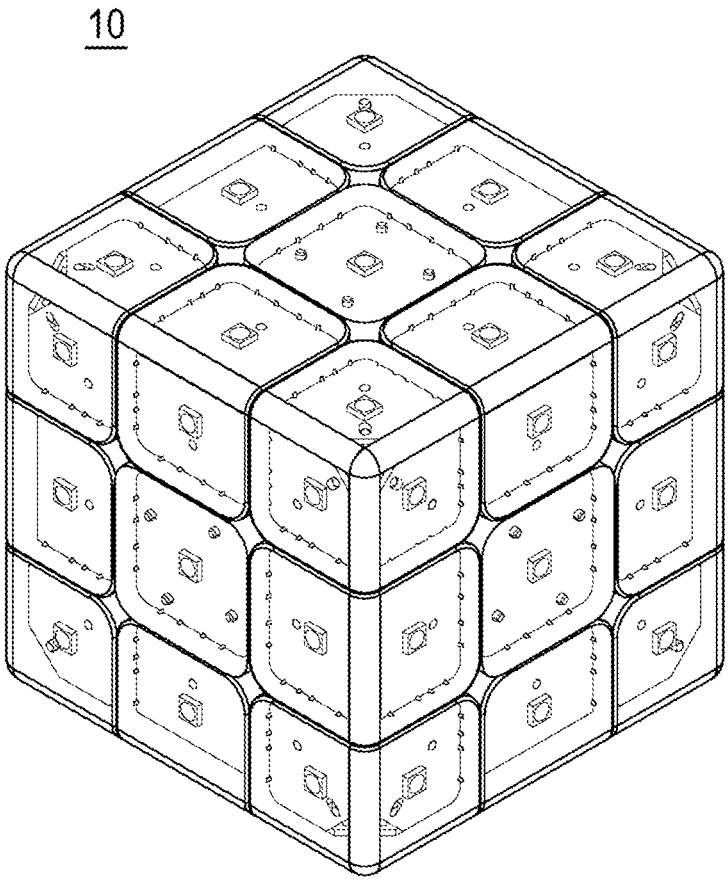
FIG. 1 is a perspective view illustrating a smart cube in accordance with an embodiment of the present disclosure.
Figure 2:
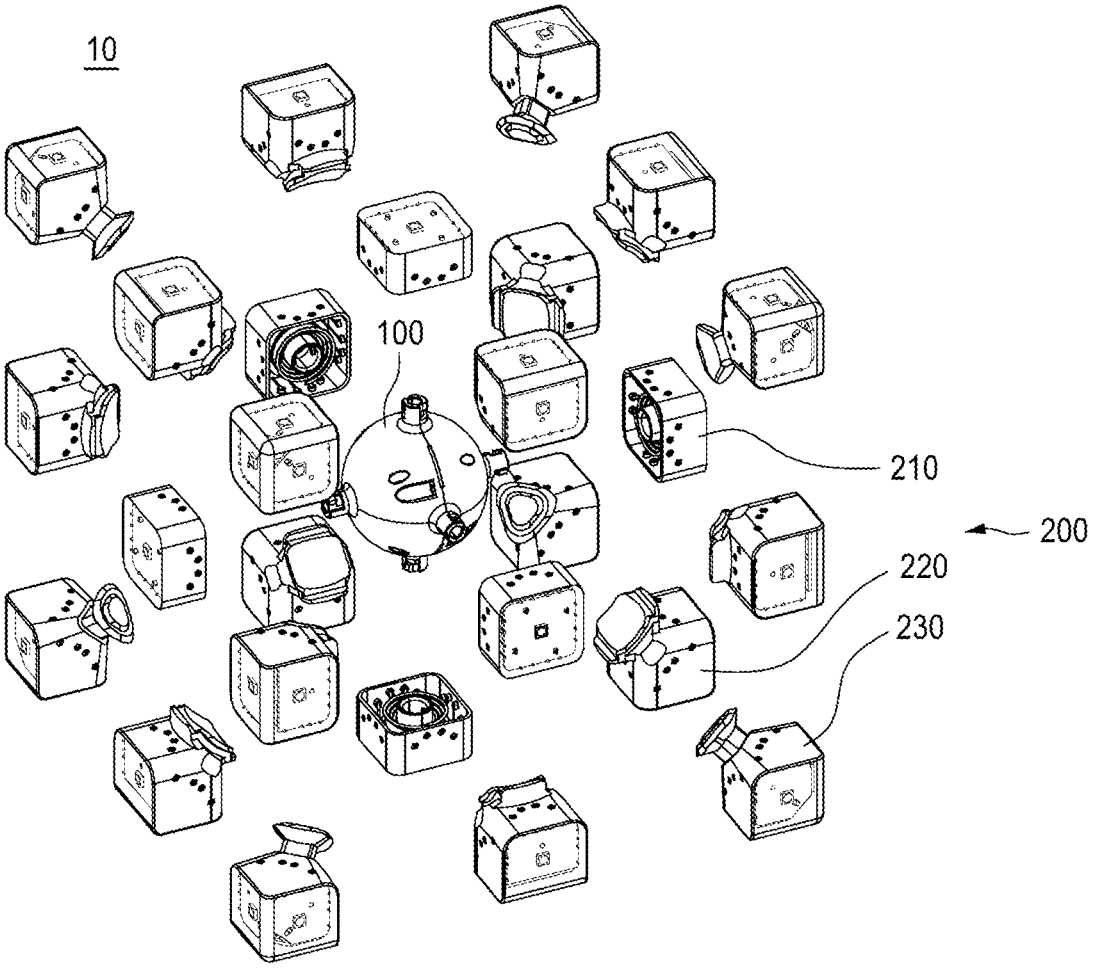
FIG. 2 is an exploded perspective view of the smart cube shown in FIG. 1.

FIG. 1 is a perspective view illustrating a smart cube in accordance with an embodiment of the present disclosure, and FIG. 2 is an exploded perspective view of the smart cube shown in FIG. 2.

Referring to FIG. 1 and FIG. 2, a smart cube 10 in accordance with an embodiment of the present disclosure may include a main frame 100 and a plurality of unit blocks 200. The main frame 100 may be in the shape of, but not limited to, a sphere. The plurality of unit blocks 200 may be coupled to the main frame 100 to constitute 6 faces of a regular hexahedron. That is, the smart cube 10 may be in the shape of a regular hexahedron, and any regular hexahedron mentioned hereinafter may be understood to refer to the smart cube 10, unless described otherwise.

Specifically, the plurality of unit blocks 200 may include a plurality of, for example, 6, center blocks 210, disposed at a center of each face of the regular hexahedron, a plurality of, for example, 12, edge blocks 220, disposed at edges of each face of the regular hexahedron, and a plurality of, for example, 8, corner blocks 230, disposed at corners of each face of the regular hexahedron.

The center blocks 210 may be rotatably coupled to the main frame 100, and the edge blocks 220 may each be restricted by 2 adjacent center blocks 210 of the edge block 220, and the corner blocks 230 may each be restricted by 3 adjacent edge blocks 220 of the corner block 230.

Therefore, the plurality of center blocks 210, the plurality of edge blocks 220 and the plurality of corner blocks 230 may be restricted with one another such that the center block 210, the edge blocks 220 and the corner blocks 230 on a same face of the regular hexahedron may rotate together. As the coupling structure of the unit blocks 200 is well-known, it will not be described in detail herein.

Figure 3:
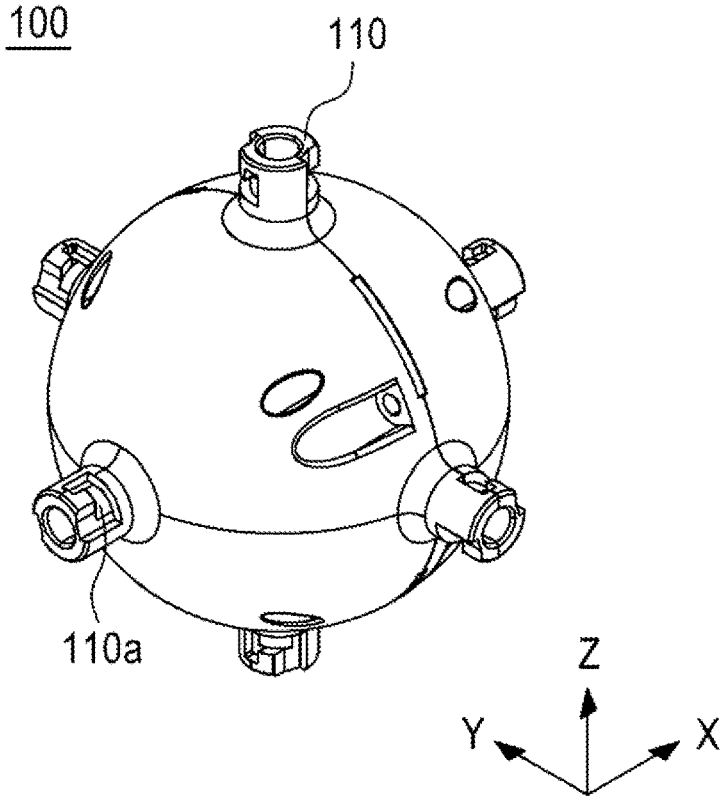
FIG. 3 is a perspective view of the main frame shown in FIG. 2.

FIG. 3 is a perspective view of the man frame shown in FIG. 2. Referring to FIG. 3, the main frame 100 may have a plurality of, for example, 6, coupling protrusions 110 formed on an outer circumferential surface thereof.

The coupling protrusions 110 may extend radially from the main frame 100. For example, a pair of coupling protrusions 110 may extend in the direction of X-axis, and another pair of coupling protrusions 110 may extend in the direction of Y-axis, which is perpendicular to the X-axis, and yet another pair of coupling protrusions 110 may extend in the direction of Z-axis, which is perpendicular to the X-axis and the Y-axis.

The plurality of coupling protrusions 110 may have the plurality of center blocks 210 rotatably coupled thereto, respectively. For example, the coupling protrusions 110 may each be in the shape of a pipe, and the center blocks 210 may each be provided with a rotation shaft configured to be inserted into the coupling protrusion 110. Moreover, the coupling protrusions 110 may each be inserted into a fixing frame, which constitutes a rotation detection unit, which will be described later, and the coupling protrusions 110 may each have a coupling groove 110*a* formed in the shape of number "7" on an outer circumferential surface thereof for keeping the fixing frame from disengaging and/or rotating.

Figure 4:
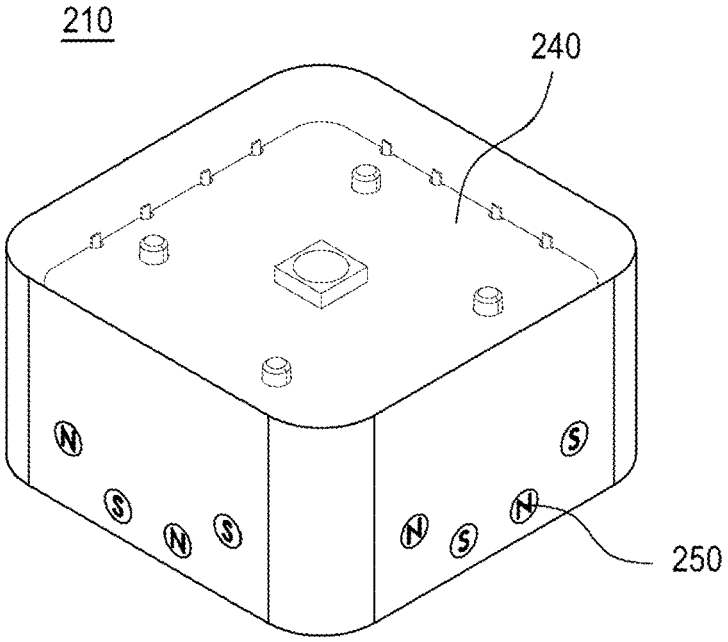
FIG. 4 is a perspective view of the center block shown in FIG. 2.
Figure 5:
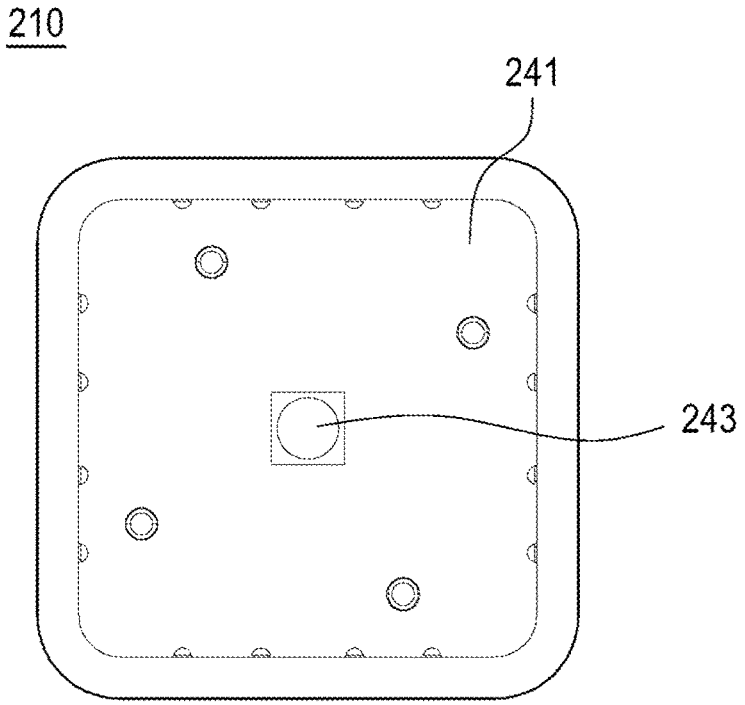
FIG. 5 illustrates an exposed surface of the center block shown in FIG. 4.
Figure 6:
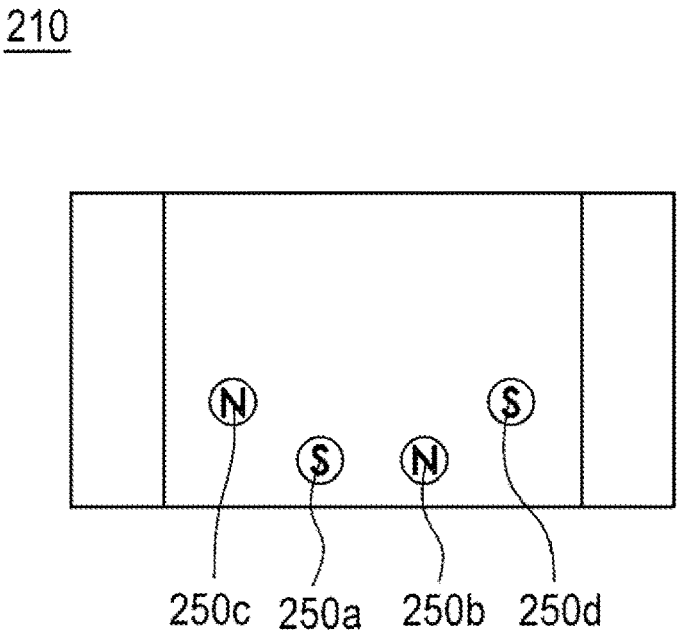
FIG. 6 illustrates a facing surface of the center block shown in FIG. 4.
Figure 7:
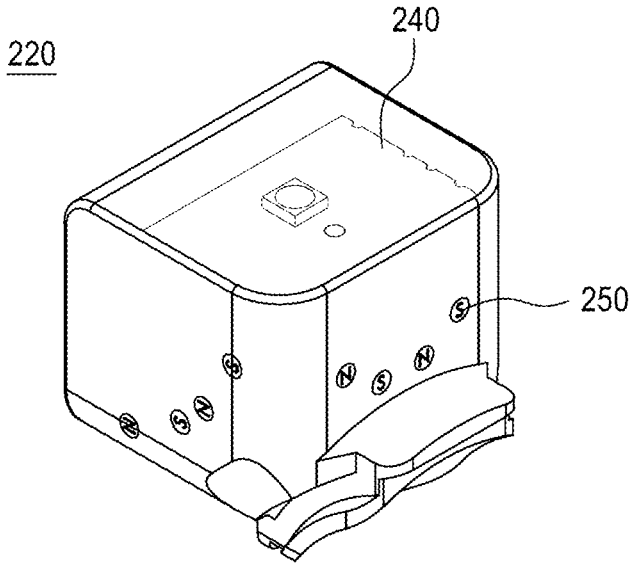
FIG. 7 is a perspective view of an edge block shown in FIG. 2.
Figure 8:
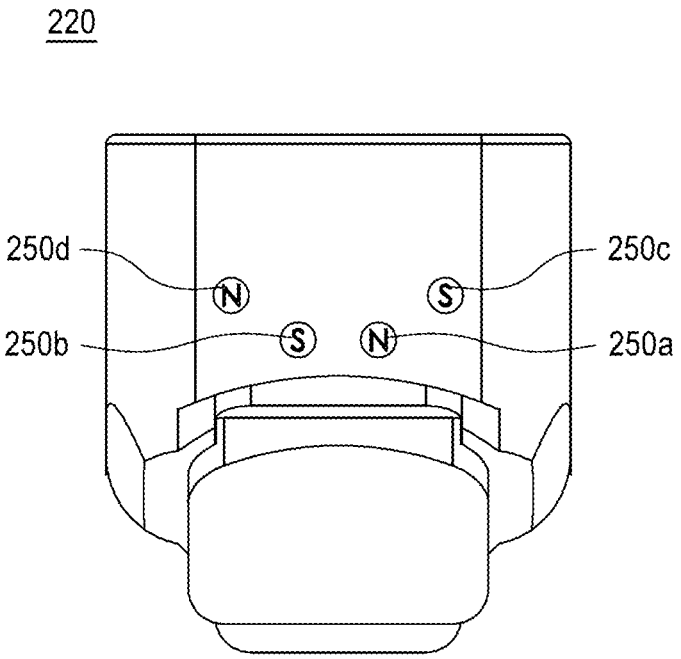
FIG. 8 illustrates a facing surface of the edge block shown in FIG. 7.
Figure 9:
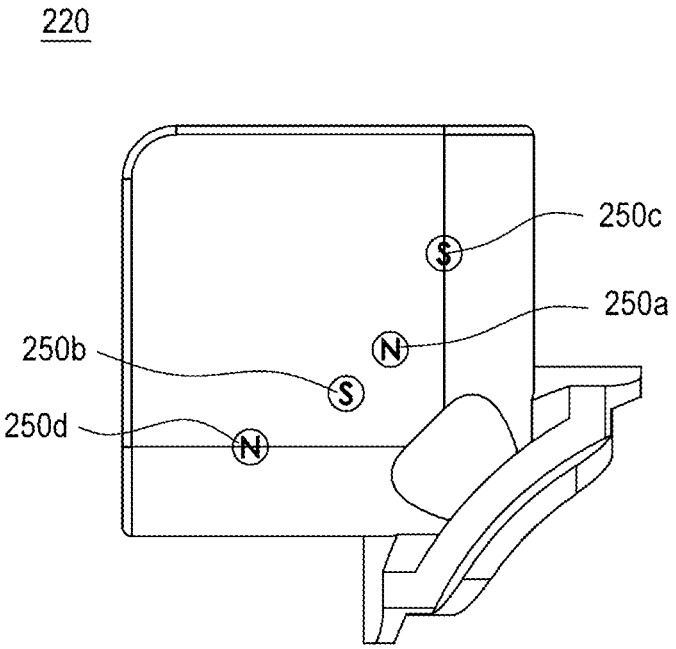
FIG. 9 illustrates another facing surface of the edge block shown in FIG. 7.
Figure 10:
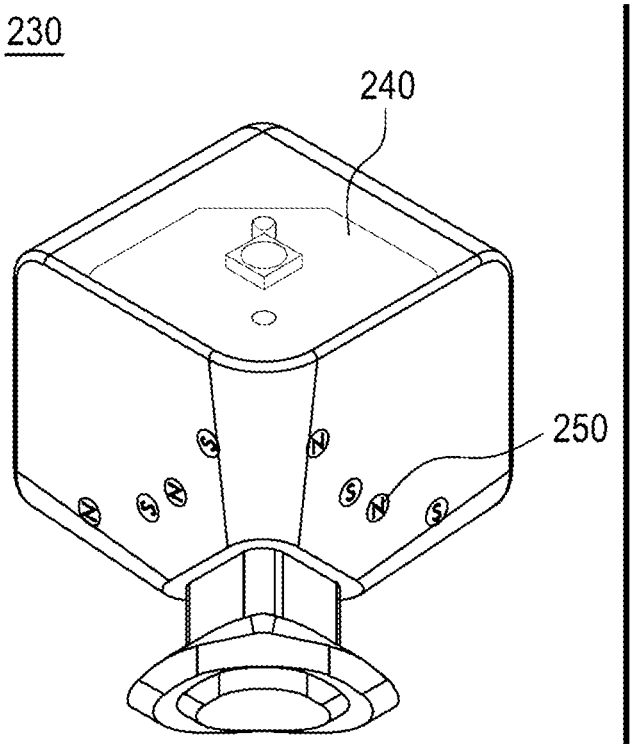
FIG. 10 is a perspective view of a corner block shown in FIG. 2.
Figure 11:
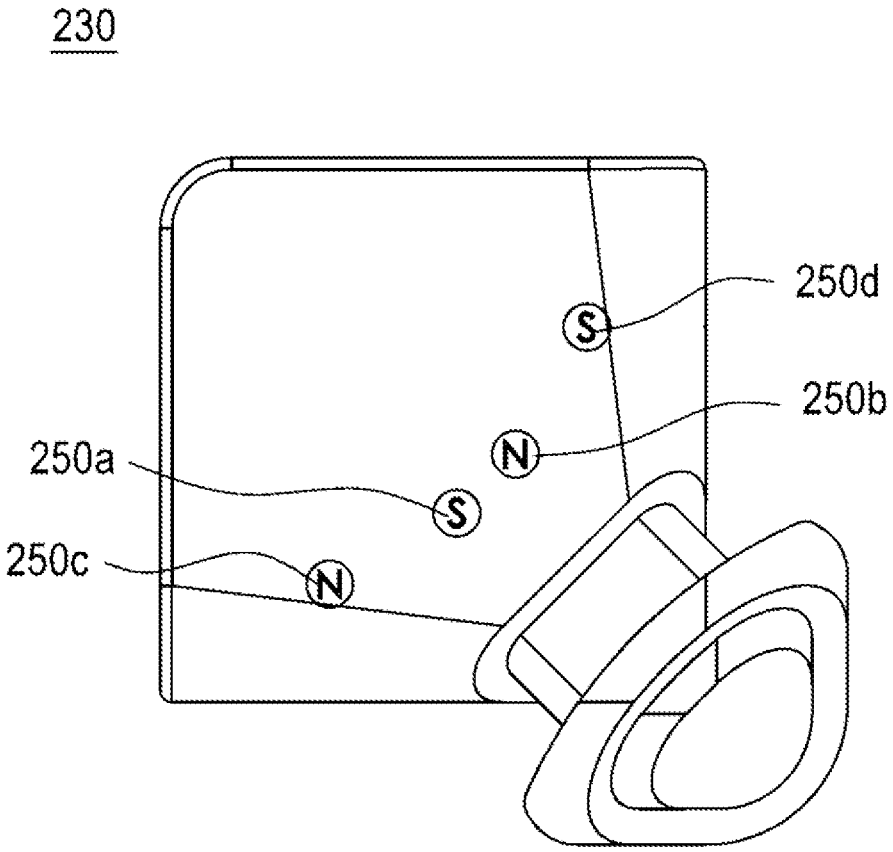
FIG. 11 illustrates a facing surface of the corner block shown in FIG. 10.

FIG. 4 is a perspective view of the center block shown in FIG. 2; FIG. 5 illustrates an exposed surface of the center block shown in FIG. 4; FIG. 6 illustrates a facing surface of the center block shown in FIG. 4; FIG. 7 is a perspective view of an edge block shown in FIG. 2; FIG. 8 illustrates a facing surface of the edge block shown in FIG. 7; FIG. 9 illustrates another facing surface of the edge block shown in FIG. 7; FIG. 10 is a perspective view of a corner block shown in FIG. 2; and FIG. 11 illustrates a facing surface of the corner block shown in FIG. 10.

Referring to FIG. 4 to FIG. 11, the unit block 200 may include a display unit 240 and a plurality of terminals 250.

The display unit 240 may be disposed on every surface of the unit block 200 that is exposed to an outside. The display unit 240 may include a substrate 241, which is disposed within the unit block 200, and a light-emitting diode 243, which is mounted on the substrate 241. As will be described later, the light-emitting diode 243 may emit light with a predetermined color or a color determined based on data transferred to the display unit 240, and the visible light generated by the light-emitting diode 243 may be irradiated to the outside through a transparent window constituting the exposed surface of the unit block 200. However, it shall be appreciated that the present disclosure is not restricted to what is described herein, and the display unit 240 may include, for example, a display panel.

The terminal 250 may be provided in plurality on a facing surface of the unit block 200 that faces another unit block 200 and may be configured for transferring power and/or data for the display unit 240. The terminal 250 may include a pair of power terminals 250*a*, 250*b* and a pair of data terminals 250*c*, 250*d* that are provided for every facing surface.

The pair of power terminals 250*a*, 250*b* may transfer electric power required for driving the display unit 240 between the unit block 200 and an adjacent unit block 200 of the unit block 200. To this end, the pair of power terminals 250*a*, 250*b* may each transfer electric power having a different electric potential. For example, first power terminal 250*a* may transfer electric power having a positive electric potential, and second power terminal 250*b* may transfer electric power having a negative electric potential.

The pair of data terminals 250*c*, 250*d* may transfer data required for controlling the display unit 240 between the unit block 200 and an adjacent unit block 200 of the unit block 200.

In an example, the pair of data terminals 250*c*, 250*d* disposed on a facing surface of the center block 210 may transfer data between one display unit 240 of the center block 210 and one display unit 240 of the edge block 220 that is disposed on a same face of the regular hexahedron as the one display unit 240 of the center block 210.

In another example, the pair of data terminals 250*c*, 250*d* disposed on a facing surface the edge block 220 that faces the corner block 230 may transfer data between two display units 240 of the edge block 220 and two display units 240 of the corner block 230 that are disposed, respectively, on same faces of the regular hexahedron as the two display units 240 of the edge block 220. Specifically, first data terminal 250*c* may transfer data between one of the display units 240 of the edge block 220 and one of the display units 240 of the corner block 230 that is disposed on a same face of the regular hexahedron as the one of the display units 240 of the edge block 220, and second data terminal 250*d* may transfer data between the other of the display units 240 of the edge block 220 and the other of the display units 240 of the corner block 230 that is disposed on a same face of the regular hexahedron as the other of the display units 240 of the edge block 220.

Figure 12:
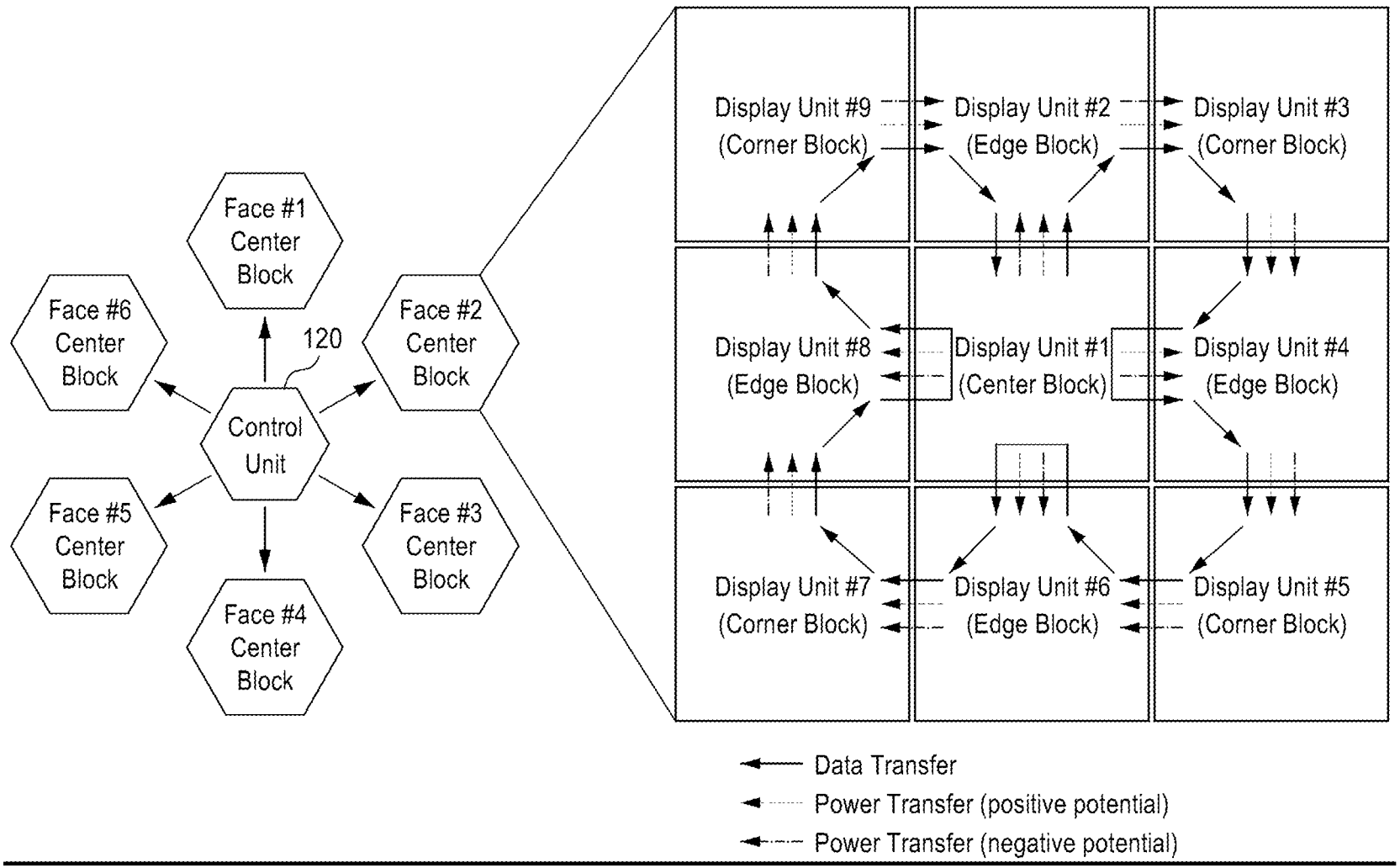
FIG. 12 illustrates data flows in the smart cube in accordance with an embodiment of the present invention.

FIG. 12 illustrates data flows in the smart cube in accordance with an embodiment of the present invention. Referring to FIG. 12, the main frame 100 may be provided with a control unit 120, which may be configured for transferring electric power and/or data to the plurality of center blocks 210. To this end, the control unit 120 may be connected to the display unit 240 of each of the plurality of center blocks 210 through, for example, a wire. The control unit 120 may be, for example, a micro controller unit (MCU).

The control unit 120 may receive a control signal from an external device, such as a user terminal, and may allow or block a power supply to the plurality of center blocks 210 and/or transfer data to the plurality of center blocks 210 based on the received control signal. The power to be supplied to the plurality of center blocks 210 may be provided by a battery mounted in the main frame 100. The data to be supplied to the plurality of center blocks 210 may be provided by the external device or loaded from a database mounted in the main frame 100 based on the control signal from the external device.

Some of the power and data received by the plurality of center blocks 210 may be transferred to the plurality of edge blocks 220 and the plurality of corner blocks 230 through the terminals 250. For example, the transfer of power through the power terminals 250*a*, 250*b* may be made between the unit blocks 200. On the other hand, the transfer of data through the data terminals 250*c*, 250*d* may be made between the display units 250.

Specifically, the transfer of data between the display units 240 may be made between the display units 240 that are disposed on a same face of the regular hexahedron, and the data starting from the display unit 240 of a center block 210 may pass through all of the display units 240 of the plurality of edge blocks 220 and the plurality of corner blocks 230 disposed on the same face of the regular hexahedron as the display unit 240 of the center block 210 before returning to the display unit 240 of the center block 210. Moreover, the data received by any of the edge blocks 220 excluding the edge block 220 that has first received the data from the center block 210 may pass through the center block 210 again before being transferred to an adjacent corner block 230.

For this, the data transferred to the plurality of center blocks 210 may include not only data required for controlling the display unit 240 of a particular center block 210 but also data required for controlling the display units 240 of the edge blocks 220 and the corner blocks 230 disposed on the same face of the regular hexahedron as the display unit 240 of the particular center block 210. Here, each of the unit blocks 200 may initially take a portion of the data and then bypass the remaining data to a next unit block 200.

Therefore, in the case where the display units 240 are repositioned when the user has maneuvered the cube, the data transferred to the plurality of center blocks 210 may need to be reconfigured according to the shifted positions of the display units 240, which will be described later.

Figure 13:
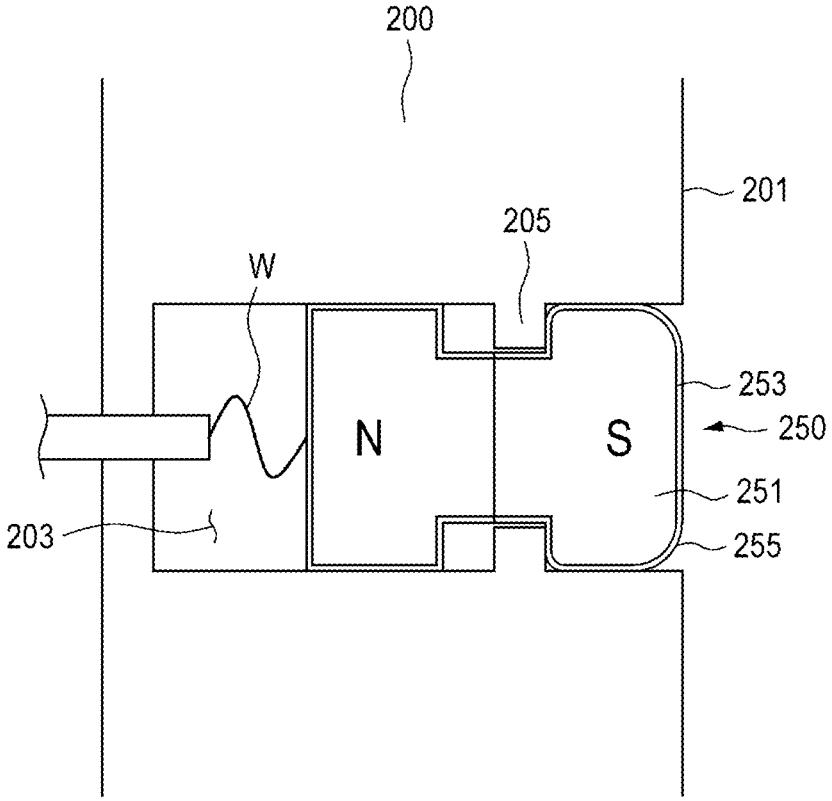
FIG. 13 is a cross-sectional view illustrating a terminal of a unit block shown in FIG. 2.

FIG. 13 is a cross-sectional view illustrating a terminal of a unit block shown in FIG. 2, and FIG. 14 to FIG. 17 illustrate an example of how the terminal shown in FIG. 13 works.

Referring to FIG. 13, the unit block 200 may have an insertion hole 203 formed on facing surface 201 thereof, and the terminal 250 may be retrievably disposed in the insertion hole 203. For example, the terminal 250 may be in the shape of a rod and may be coupled with the insertion hole 203 such that the terminal 250 may slide in the lengthwise direction thereof to be retrieved within the insertion hole 203. Moreover, the terminal 250 may be electrically coupled with the display unit 240 via a flexible wire W so as to ensure an electrical connection between the terminal 250 and the display unit 240 when the terminal 250 slides.

Moreover, the terminal 250 may include a permanent magnet 251 for allowing the polarity of a retrieved end of the terminal 250 to be opposite to the polarity of an inserted end of the terminal 250. Here, the retrieved end and the inserted end of the terminal 250 may refer to either lengthwise end of the terminal 250, and the retrieved end may particularly refer to the lengthwise end of the terminal 250 that is being ejected out of the insertion hole 203. The permanent magnet 251 may provide, but not limited to, a passage for transferring the electric power and/or data.

For instance, the terminal 250 may further include a conductive layer 253 configured to envelop the permanent magnet 251 to provide a passage for transferring the electric power and/or data. In such a case, the flexible wire W may be directly coupled to the conductive layer 253, thereby facilitating a more efficient transfer of electric power and/or data.

Referring to FIG. 14 to FIG. 17, the permanent magnet 251 may allow the polarity of the retrieved end of the terminal 25 to be opposite to the polarity of a retrieved end of a terminal 250 of another unit block 200 such that the terminal 250 may be retrieved from the insertion hole 203 and adhered to the terminal 250 of the other unit block 200 by a magnetic force. For instance, the polarity of the retrieved end of a particular terminal 250 may be a north magnetic pole while the polarity of the retrieved end of the terminal 250 of the other unit block 200 to which the particular terminal 250 is to be adhered may be a south magnetic pole.

Meanwhile, facing surfaces 201 of a pair of unit blocks 200 may be spaced apart from each other. Accordingly, when the user maneuvers the cube, a frictional resistance between the pair of unit blocks 200 may be minimized.

Moreover, the polarities of the retrieved ends of a pair of power terminals 250*a*, 250*b* disposed on a same facing surface 201 may be opposite to each other. For instance, as for the first power terminal 250*a* and the second power terminal 250*b* that are disposed on the same facing surface 201 of one unit block 200, the retrieved end of the first power terminal 250*a* may be a north magnetic pole, and the retrieved end of the second power terminal 250*b* may be a south magnetic pole.

On the contrary, as for the first power terminal 250*a* and the second power terminal 250*b* disposed on an opposite facing surface 201 of another unit block 200, the retrieved end of the first power terminal 250*a* may be a south magnetic pole, and the retrieved end of the second power terminal 250*b* may be a north magnetic pole.

Accordingly, in a pair of unit blocks 200, a pair of first power terminals 250*a* may be adhered to each other by the magnetic force (i.e., attraction) and a pair of second power terminals 250*b* may be adhered to each other by the magnetic force (i.e., attraction), but the first power terminal 250*a* and the second power terminal 250*b* may be prevented by the magnetic force (i.e., repulsion) from being adhered to each other and supplying electric power of different electric potentials.

As the smart cube 10 becomes increasingly smaller, it is more likely that the first power terminal 250*a* and the second power terminal 250*b* will overlap with each other during the movement or rotation, but the present disclosure may contribute to preventing the first power terminal 250*a* and the second power terminal 250*b* from making a contact with each other. Similarly, a pair of data terminals 250*c*, 250*d* disposed on a same facing surface 201 may have opposite polarities at retrieved ends thereof.

Figure 14:
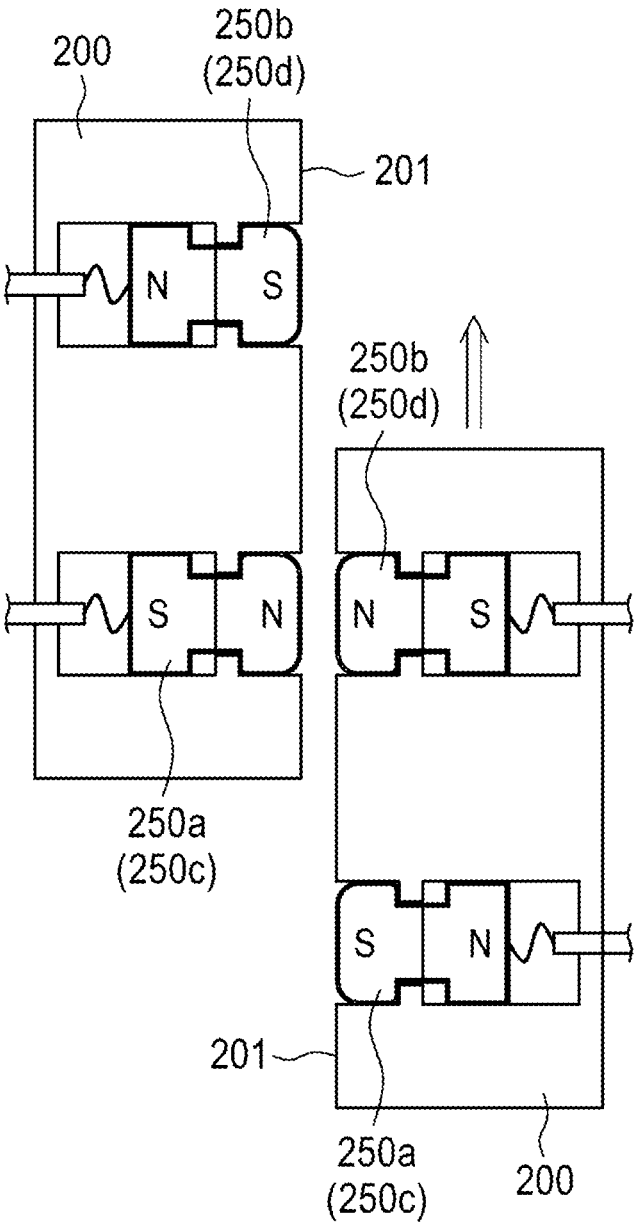
FIG. 14 to FIG. 17 illustrate an example of how the terminal shown in FIG. 13 works.

Referring to FIG. 14, when one unit block 200 is stationary and another unit block 200 rotates to approach the stationary unit block 200, the first power terminal 250*a* of the stationary unit block 200 and the second power terminal 250*b* of the rotating unit block 200 may be maximally inserted into their respective insertion hole 203 by the magnetic force (i.e., repulsion).

Figure 15:
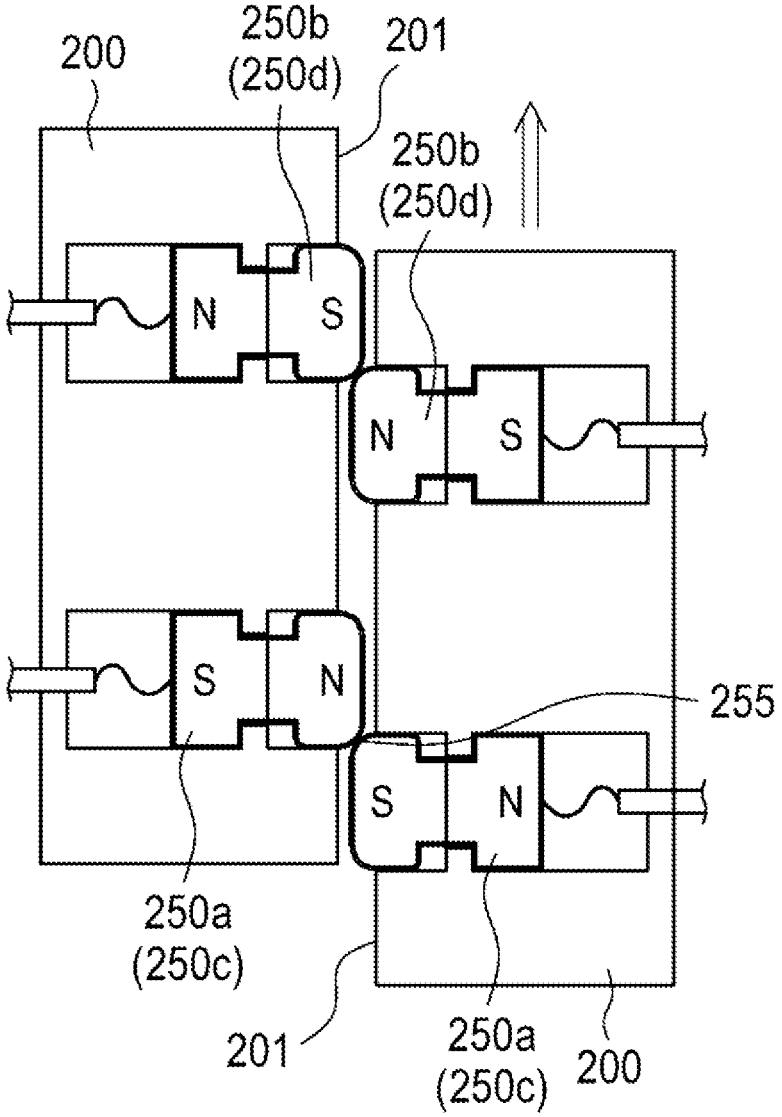

Referring to FIG. 15, when the rotating unit block 200 of FIG. 14 rotates further and the first power terminal 250*a* of the rotating unit block 200 approaches the first power terminal 250*a* of the stationary unit block 200, the first power terminal 250*a* of the stationary unit block 200 and the first power terminal 250*a* of the rotating unit block 200 may be retrieved from their respective insertion holes 203 by the magnetic force (i.e., attraction). Here, the terminal 250 may have a rounded portion 255 formed at edge portions of the retrieved end thereof, thereby minimizing a frictional resistance caused by collision between the terminals 250.

A stopper protrusion 205 may be formed on an inner circumferential surface of the insertion hole 203 to restrict a maximum retrieval length of the terminal 250, and the stopper protrusion 205 may allow the terminal 250 of the stationary unit block 200 and the terminal 250 of the rotating unit block 200 to contact with each other at the rounded portion 255 when retrieved to the maximum retrieval length by the magnetic force (i.e., attraction).

Figure 16:
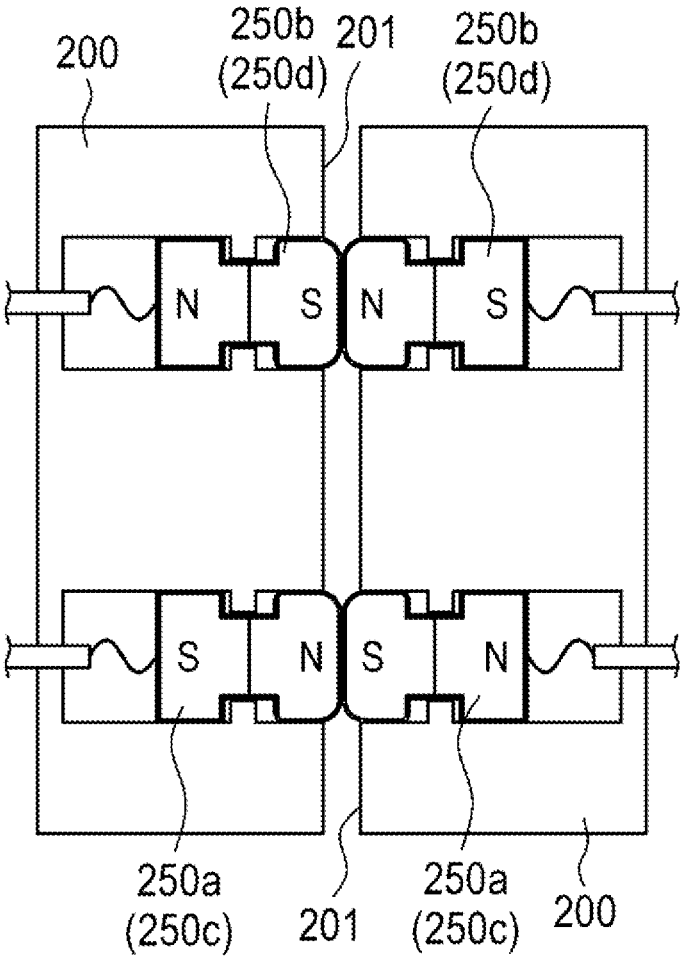

Referring to FIG. 16, when the rotating unit block 200 of FIG. 15 further rotates and the first power terminal 250*a* of the rotating unit block 200 is aligned with the first power terminal 250*a* of the stationary unit block 200, the first power terminals 250*a* may be adhered to each other by the magnetic force (i.e., attraction).

Figure 17:
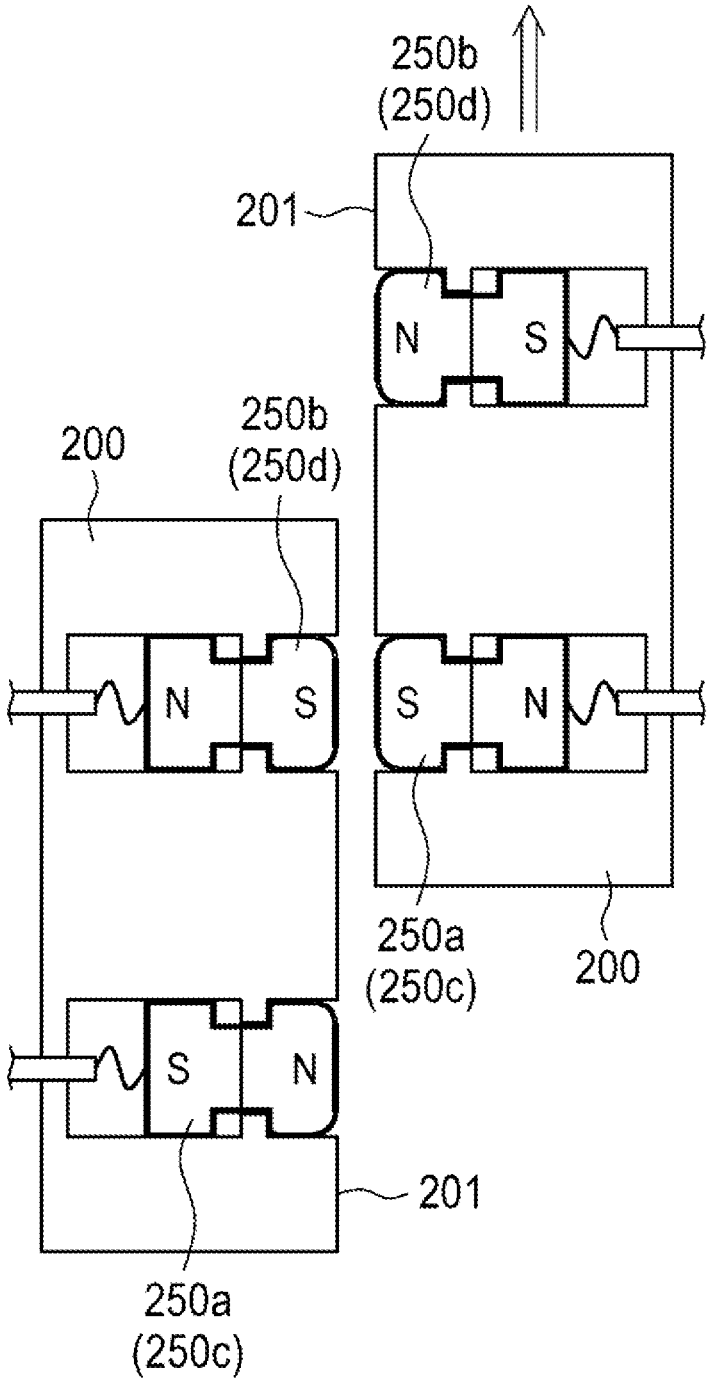

Referring to FIG. 17, when the rotating unit block 200 of FIG. 16 further rotates and the first power terminal 250*a* of the rotating unit block 200 approaches the second power terminal 250*b* of the stationary unit block 200, the second power terminal 250*b* of the stationary unit block 200 and the first power terminal 250*a* of the rotating unit block 200 may be maximally inserted into their respective insertion holes 203 by the magnetic force (i.e., repulsion).

Figure 18:
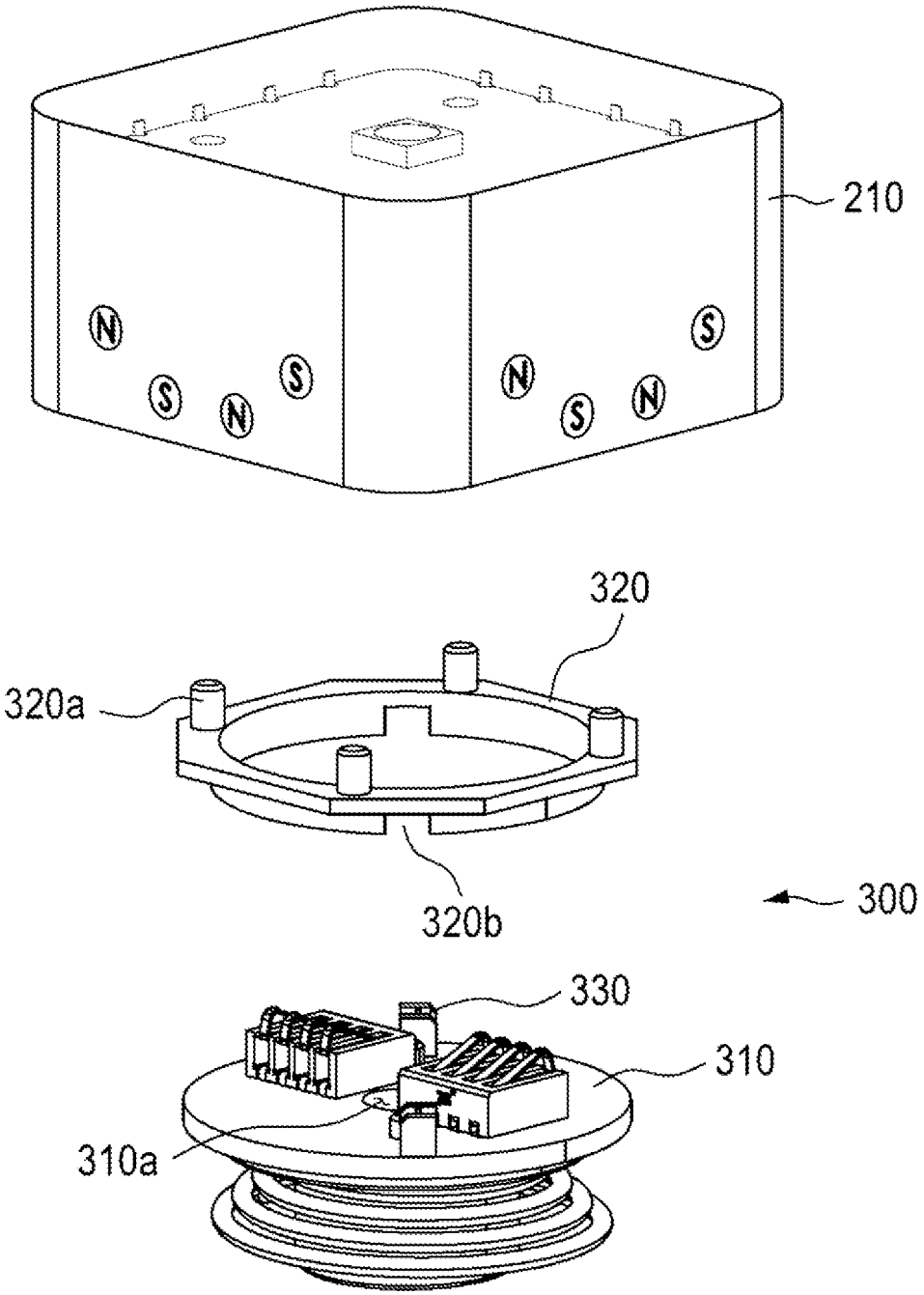
FIG. 18 is an exploded perspective view of a rotation detection unit.
Figure 19:
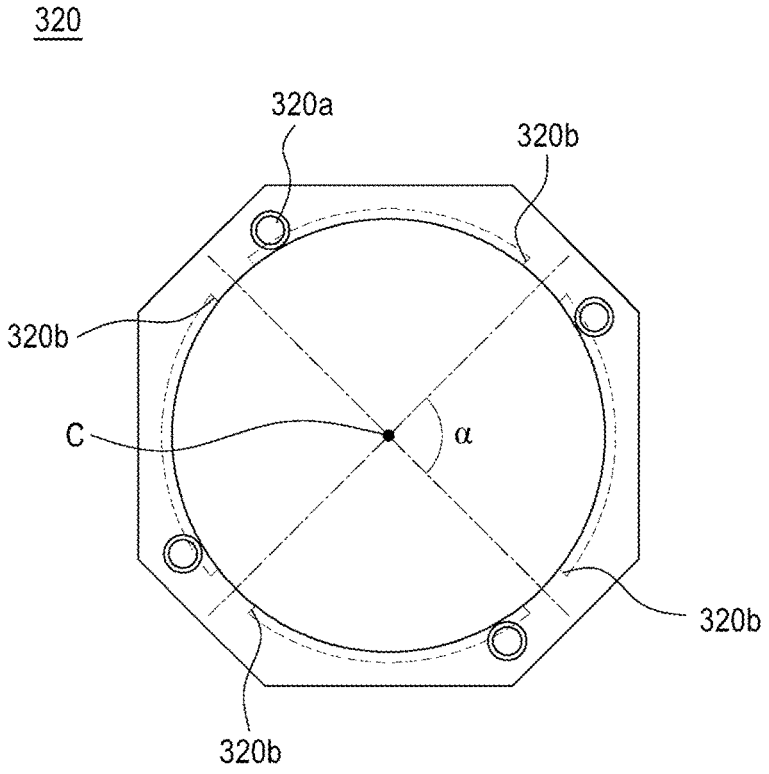
FIG. 19 is a top view of the circular ring shown in FIG. 18.
Figure 20:
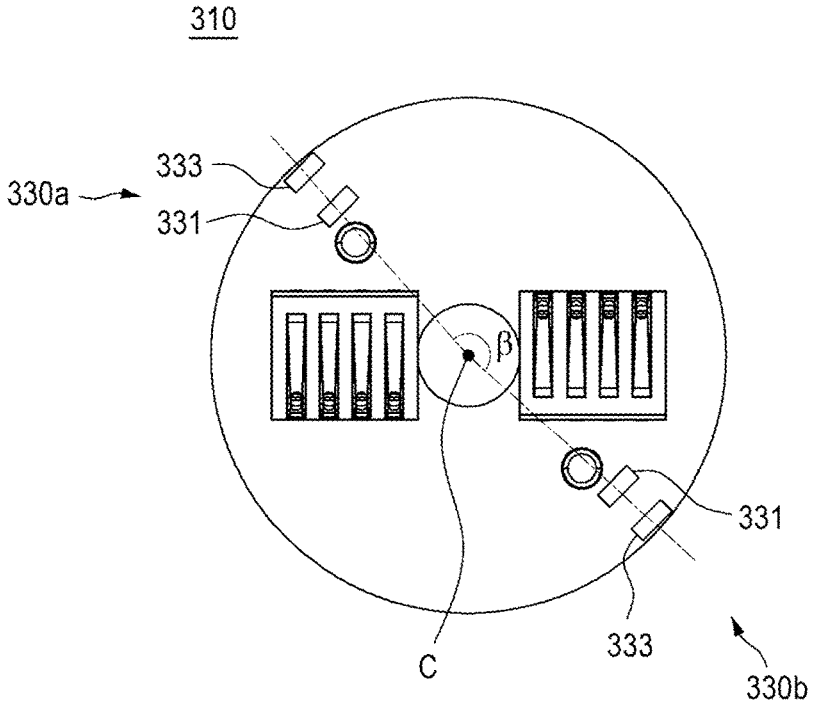
FIG. 20 is a top view of the fixing frame shown in FIG. 18.
Figure 21:
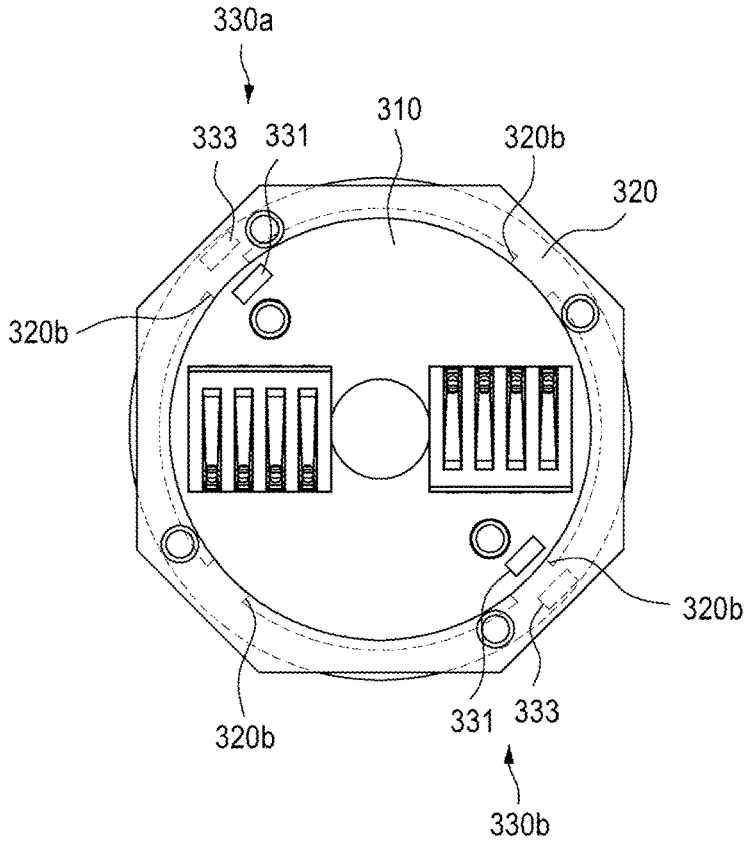
FIG. 21 illustrates an example of an arrangement between the circular ring and the photo interrupter sensor shown in FIG. 18.

FIG. 18 is an exploded perspective view of a rotation detection unit; FIG. 19 is a top view of the circular ring shown in FIG. 18; FIG. 20 is a top view of the fixing frame shown in FIG. 18; and FIG. 21 illustrates an example of an arrangement between the circular ring and the photo interrupter sensor shown in FIG. 18.

Referring to FIG. 18 to FIG. 21, the smart cube 10 may further include a plurality of rotation detection units 300 configured to detect rotation directions and rotation angles of the plurality of center blocks 210, respectively. The rotation detection units 300 may each include a fixing frame 310, a circular ring 320 and a pair of photo interrupter sensors 330.

The fixing frame 310 may be coupled to the main frame 100 and may maintain its stationary state despite the rotation of the center block 210. For example, the fixing frame 310 may have a coupling hole 310*a* formed at the center thereof, the coupling protrusion 110 of the main frame 110 being inserted in the coupling hole 310*a*, and the coupling hole 310*a* may have a disengagement prevention protrusion formed on an inner circumferential surface thereof, the disengagement prevention protrusion being inserted in the coupling groove 110*a* formed on the outer circumferential surface of the coupling protrusion 110. Moreover, the fixing frame 310 may have a spring, for example, a coil spring, coupled to a lower portion thereof, and the spring may be supported by a pair of adjacent edge blocks 220 and press, by an elastic force, the fixing frame 310 toward the center block 210 such that the disengagement prevention protrusion may be fixed to an end of the coupling groove 110 formed in the shape of number "7."

The circular ring 320 may be coupled to the center block 210 to rotate with the center block 210. To this end, the circular ring 320 may be provided with an insertion protrusion 320*a* being coupled to the center block 210. The circular ring 320 may be in the shape of a circle, of which the center coincides with a rotation axis C of the center block 210. The circular ring 320 may be provided with 4 sensing holes 320*b*, which radially penetrate the circular ring 320, and the 4 sensing holes 320*b* may be arranged at an interval of 90 degrees about the rotation axis C of the center block 210. That is, a first angle $\alpha$ between 2 adjacent sensing holes 320*b* may be 90 degrees.

The pair of photo interrupter sensors 330 may be each coupled to the fixing frame 310 and may be arranged at an interval greater than or smaller than 180 degrees about the rotation axis C of the center block 210. For instance, a second angle $\beta$ between a first photo interrupter sensor 330*a* and a second photo interrupter sensor 330*b* may be smaller than 180 degrees.

The photo interrupter sensor 330 may include a light-emitting unit 331 and a light-receiving unit 333 disposed on an inner side and an outer side, respectively, of the circular ring 320. Although the light-emitting unit 331 is described to be disposed on the inner side of the circular ring 320 and the light-receiving unit 333 is described to be disposed on the outer side of the circular ring 320, the arrangement of the light-emitting unit 331 and the light-receiving unit 333 of the present disclosure is not limited to what is described herein.

The light-emitting unit 331 and the light-receiving unit 333 may be disposed to face each other in the radial direction of the circular ring 320. Accordingly, the photo interrupter sensor 330 may generate a detection signal when the sensing hole 320*b* of the circular ring 320 is positioned between the light-emitting unit 331 and the light-receiving unit 333 as the circular ring 320 rotates with the center block 210.

The rotation detection unit 300 may detect the direction and angle of rotation of the center block 210 based on the order and number of detections signals generated by the pair of photo interrupter sensors 330.

In an example, if the center block 210 with the arrangement shown in FIG. 21 rotates 90 degrees clockwise, the first photo interrupter sensor 330*a* may generate a detection signal after the second photo interrupter sensor 330*b* generates a detection signal, and if the center block 210 with the arrangement shown in FIG. 21 rotates 90 degrees counterclockwise, the second photo interrupter sensor 330*b* may generate a detection signal after the first photo interrupter sensor 330*a* generates a detection signal. As such, the direction of rotation of the center block 210 may be determined based on which of the photo interrupter sensors 330 generates the detection signal first.

In another example, the first photo interrupter sensor 330*a* and the second photo interrupter sensor 330*b* may each generate a detection signal once whenever the center block 210 rotates 90 degrees clockwise or counterclockwise. As such, the angle of rotation of the center block 210 may be determined based on the number of detection signals generated by any one of the photo interrupter sensors 330.

Moreover, the control unit 120 may calculate the final position of each of the display units 240 based on the initial position of each of the display units 240 and the results of detection by the plurality of rotation detection units 300. Moreover, the control unit 120 may reconfigure data in the initial position of each of the display units 240 to correspond with the final position of each of the display units 240 and transfer the reconfigured data to each of the plurality of center blocks 210.

Figure 22:
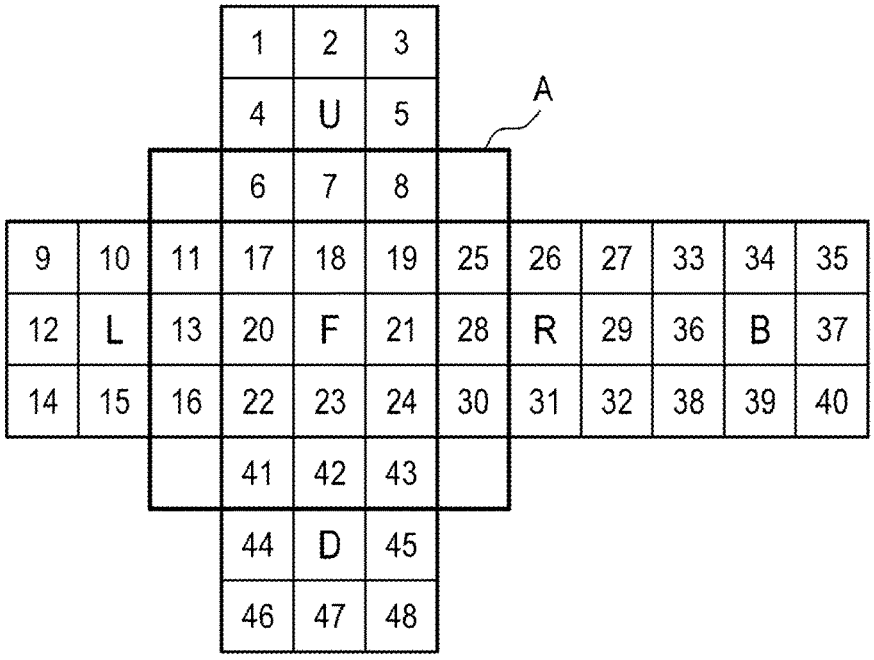
FIG. 22 and FIG. 23 illustrates an example of how the control unit shown in FIG. 12 computes the final position of each of the display units.
Figure 23:
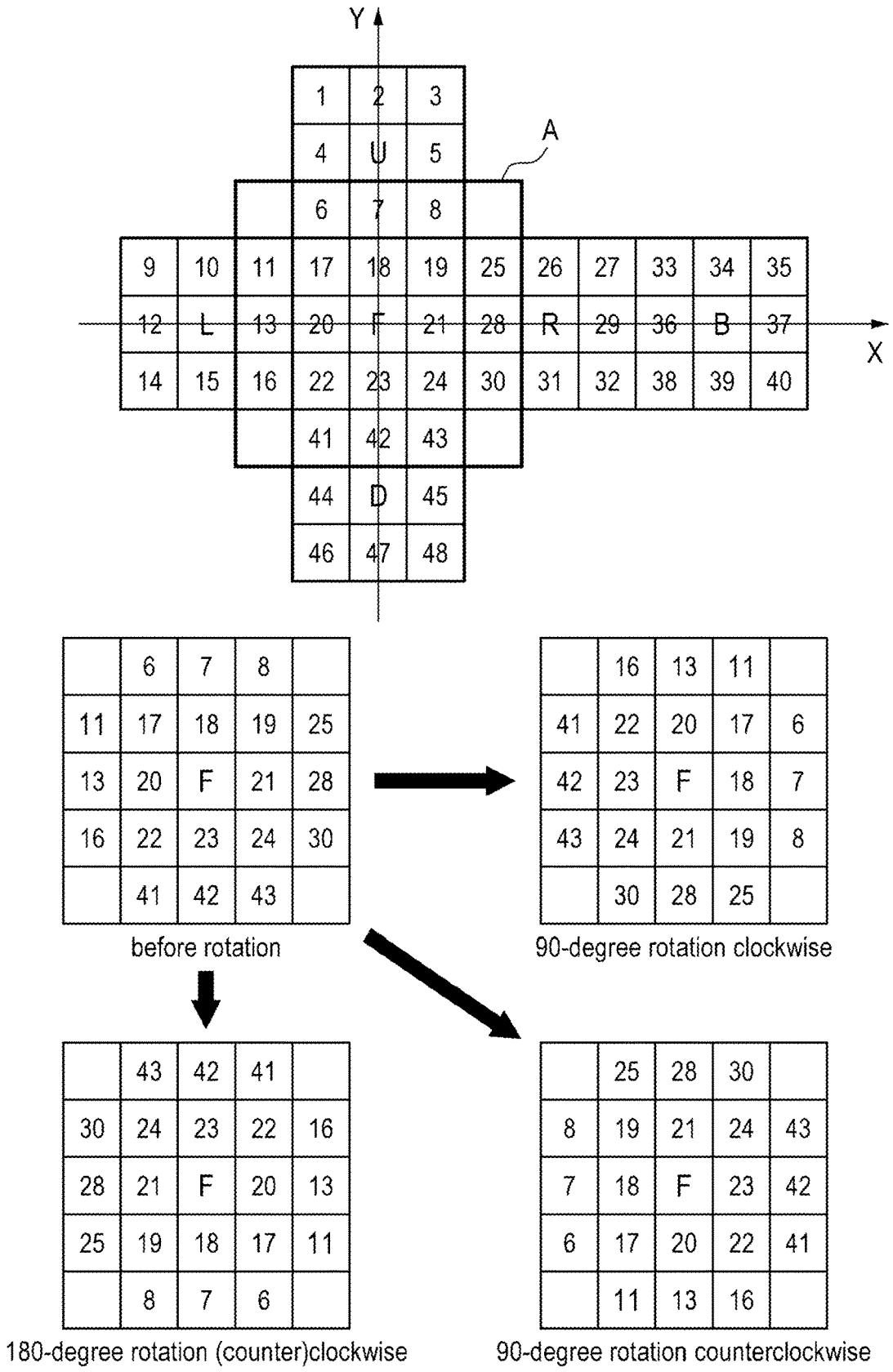

FIG. 22 and FIG. 23 illustrates an example of how the control unit shown in FIG. 12 computes the final position of each of the display units.

Referring to FIG. 22, each of the display units 240 may be assigned with a different address value. For example, the display unit 240 that is centrally positioned on each face of the smart cube 10 may be assigned with an address value, such as F (i.e., front face), B (i.e., back face), L (i.e., left side face), R (i.e., right side face), U (i.e., up face) or D (i.e., down face), which characterizes the face on which the display unit 240 is disposed, and each of the rest of the display units 240 may be assigned with an address value of a different number, ascending from 1.

FIG. 22 is an illustration of the smart cube 10 as if every face of the smart cube 10 is virtually unfolded about the rotating face of the smart cube 10 and is on the same plane as the rotating face, for an easier visualization of the address values assigned to the display units 240.

Once the rotating face of the smart cube 10 rotates, the display units 240 in the area marked with "A" change their positions. Accordingly, once an S matrix is obtained using matrices, such as Mathematical Equation 1 shown below, indicating the arrangements of the display units 240 in area "A" before and after the rotation, then the final positions of the display units 240 may be calculated using the S matrix.

$$\begin{bmatrix} 0 & 6 & 7 & 8 & 0 \\ 11 & 17 & 18 & 19 & 25 \\ 13 & 20 & 0 & 21 & 28 \\ 16 & 22 & 23 & 24 & 30 \\ 0 & 41 & 42 & 43 & 0 \end{bmatrix} \times S = \begin{bmatrix} 0 & 16 & 13 & 11 & 0 \\ 41 & 22 & 20 & 17 & 6 \\ 42 & 23 & 0 & 18 & 7 \\ 43 & 24 & 21 & 19 & 8 \\ 0 & 30 & 28 & 25 & 0 \end{bmatrix}$$ [Mathematical Equation 1]

Meanwhile, the values of the center and corners of the matrices of Mathematical Equation 1 shown above indicating the arrangements of the display units 240 may each be expressed with 0 (zero), and the matrix indicting the arrangement of the display units 240 after the rotation in Mathematical Equation 1 illustrates an example of the rotating face rotated clockwise by 90 degrees.

Referring to FIG. 23, the display units 240 may be each assigned with a different address value, as described above. Then, defining an axis horizontally passing through F, which is the central display unit of the rotating face, as X-axis and an axis vertically passing through F as Y-axis, the position and address value of each of the display units 240 may be expressed with the matrix of Mathematical Equation 2 shown below.

$$\begin{bmatrix} X-coodinate \\ Y-coodinate \\ \text{address value} \end{bmatrix}$$ [Mathematical Equation 2]

Then, since the display units 240 in the area marked with "A" change their positions when the rotating face of the smart cube 10 rotates, the final positions and address values of the display units 240 may be obtained by substituting the matrix of Mathematical Equation 2, indicating the position and address value of each of the display units 240 in the area marked with "A," into Mathematical Equation 3 shown below. Here, 0 may refer to an angle by which the rotating face rotates counterclockwise.

$$\begin{bmatrix} \cos\theta & -\sin\theta & 0 \\ \sin\theta & \cos\theta & 0 \\ 0 & 0 & 1 \end{bmatrix} \times \begin{bmatrix} X-coodinate \\ Y-coodinate \\ \text{address value} \end{bmatrix} = \begin{bmatrix} \text{final } X-coodinate \\ \text{final } Y-coodinate \\ \text{address value} \end{bmatrix}$$ [Mathematical Equation 3]

In an example, the X-coordinate and the Y-coordinate of the display unit 240 having the address value of 11 are −2 and 1, respectively, and if the rotating face has rotated 90 degrees clockwise, θ is −90 degrees. By substituting these values in Mathematical Equation 3, the final X-coordinate and Y-coordinate of the display unit 240 having the address value of 11 will be computed to be 1 and 2, respectively.

In another example, the X- and Y-coordinates of the display unit 240 having the address value of 11 are −2 and 1, respectively, and if the rotating face has rotated 90 degrees counterclockwise, θ is 90 degrees. By substituting these values in Mathematical Equation 3, the final X-coordinate and Y-coordinate of the display unit 240 having the address value of 11 will be computed to be −1 and −2, respectively.

In yet another example, the X- and Y-coordinates of the display unit 240 having the address value of 11 are −2 and 1, respectively, and if the rotating face has rotated 180 degrees clockwise or counterclockwise, θ is −180 degrees or 180 degrees. By substituting these values in Mathematical Equation 3, the final X-coordinate and Y-coordinate of the display unit 240 having the address value of 11 will be computed to be 2 and −1, respectively.

While a certain embodiment of the present disclosure has been described, it shall be appreciated that the described embodiment is exemplary only and that the present disclosure is by no means limited to the described embodiment. Anyone of ordinary skill in the art to which the present disclosure pertains will readily be able to modify or vary the described embodiment by means of supplementing, modifying, deleting or adding one or more elements of the present disclosure within the scope of the present disclosure, as defined by the appended claims, and such supplementation, modification, deletion or addition shall be deemed to be within the scope of the present disclosure.

| DESCRIPTION OF KEY ELEMENTS | |
|---|---|
| 10: | smart cube |
| 100: | main frame |
| 110: | coupling protrusion |
| 110a: | coupling groove |
| 120: | control unit |
| 200: | unit block |
| 201: | facing surface |
| 203: | insertion hole |
| 210: | center block |
| 220: | edge block |
| 230: | corner block |
| 240: | display unit |
| 241: | substrate |
| 243: | light-emitting diode |
| 250: | terminal |
| 250a: | first power terminal |
| 250b: | second power terminal |
| 250c: | first data terminal |
| 250d: | second data terminal |
| 251: | permanent magnet |
| 253: | conductive layer |
| 255: | rounded portion |
| 300: | rotation detection unit |
| 310: | fixing frame |
| 310a: | coupling hole |
| 320: | circular ring |
| 320a: | insertion protrusion |
| 320b: | sensing hole |
| 330: | photo interrupter sensor |
| 330a: | first photo interrupter sensor |
| 330b: | second photo interrupter sensor |
| 331: | light-emitting unit |
| 333: | light-receiving unit |

What is claimed is:

1. A smart cube, comprising:

a main frame; and a plurality of unit blocks coupled to the main frame and constituting six faces of a regular hexahedron, wherein the unit block comprises: a display unit disposed on a surface of the unit block that is exposed to an outside; and a plurality of terminals disposed on a facing surface of the unit block facing another unit block for transferring electric power and data for the display unit, wherein the terminal is retrievably disposed in an insertion hole formed on the facing surface of the unit block, wherein the terminal comprises a permanent magnet for allowing a polarity of a retrieved end of the terminal to be opposite to a polarity of a retrieved end of a terminal of the other unit block such that the terminal is retrieved from the insertion hole and adhered to the terminal of the other unit block by a magnetic force, wherein the plurality of unit blocks comprise: a plurality of center blocks rotatably coupled to the main frame and disposed at a center of each face of the regular hexahedron; a plurality of edge blocks disposed at edges of each face of the regular hexahedron; and a plurality of corner blocks disposed at corners of each face of the regular hexahedron, wherein the center block, the edge blocks and the corner blocks disposed on a same face of the regular hexahedron are engaged with one another so as to be rotated with one another, wherein the main frame is provided with a control unit for transferring the electric power and data to the plurality of center blocks, wherein data is transferred between the display units disposed on a same face of the regular hexahedron, wherein the smart cube further comprises a plurality of rotation detection units configured to detect a rotation direction and a rotation angle of each of the plurality of center blocks, wherein the control unit is configured to compute a final position of each of the display units based on an initial position of each of the display units and results of detection by the plurality of rotation detection units and transfer data adapted for the final position of each of the display units to the plurality of center blocks, wherein the rotation detection unit comprises: a fixing frame being coupled to the main frame; a circular ring being coupled to the center block, a center of the circular ring coinciding with a rotation axis of the center block; and a pair of photo interrupter sensors being coupled to the fixing frame, wherein the circular ring comprises 4 sensing holes radially penetrating the circular ring, wherein the photo interrupter sensor comprises a light-emitting unit and a light-receiving unit disposed on an inner side and an outer side, respectively, of the circular ring and facing each other in a radial direction of the circular ring, wherein detection signals are generated when the sensing holes are positioned between the light-emitting unit and the light-receiving unit by the rotation of the circular ring, wherein the 4 sensing holes are arranged at an interval of 90 degrees about the rotation axis of the center block, and wherein the pair of photo interrupter sensors are arranged at an interval greater than or smaller than 180 degrees about the rotation axis of the center block.

2. The smart cube as set forth in claim 1, wherein the terminal is slidably coupled with the insertion hole and electrically connected with the display unit through a flexible wire.

3. The smart cube as set forth in claim 2, wherein the terminal further comprises a conductive layer configured to envelop the permanent magnet to provide a passage for transferring the electric power or data, the wire being coupled to the conductive layer.

4. The smart cube as set forth in claim 1, wherein the terminal has a rounded portion formed at edge portions on the retrieved end of the terminal.

5. The smart cube as set forth in claim 4, wherein a stopper protrusion configured for restricting a maximum retrieval length of the terminal is formed on an inner circumferential surface of the insertion hole, and wherein the terminal and a terminal of another unit block is in contact with each other at the rounded portion when retrieved to the maximum retrieval length.

6. The smart cube as set forth in claim 1, wherein the terminal comprises a pair of power terminals and a pair of data terminals disposed on every facing surface.

7. The smart cube as set forth in claim 6, wherein the pair of power terminals each transfer electric power having a different electric potential, and polarities at the retrieved ends of the pair of power terminals are opposite to each other.

8. The smart cube as set forth in claim 6, wherein data starting from a particular center block passes through all of the plurality of edge blocks and the plurality of corner blocks disposed on a same face as the particular center block and then returns to the particular center block, and wherein data received by edge blocks excluding an edge block receiving the data first from the particular center block passes through the particular center block before being transferred to corner blocks.

9. The smart cube as set forth in claim 1, wherein the rotation detection unit is configured to detect the rotation direction and the rotation angle of the center block based on the order and number of detection signals generated by the pair of photo interrupter sensors.

* * * * *